US009266225B2

(12) United States Patent
Schunke

(10) Patent No.: US 9,266,225 B2
(45) Date of Patent: Feb. 23, 2016

(54) RING RATCHET SPANNER

(75) Inventor: Hermann Schunke, Hilchenbach (DE)

(73) Assignee: Schunke GmbH, Hilchenbach (DE)

( * ) Notice: Subject to any disclaimer, the term of this patent is extended or adjusted under 35 U.S.C. 154(b) by 261 days.

(21) Appl. No.: 14/119,285

(22) PCT Filed: May 15, 2012

(86) PCT No.: PCT/EP2012/059053
§ 371 (c)(1),
(2), (4) Date: Nov. 21, 2013

(87) PCT Pub. No.: WO2012/159941
PCT Pub. Date: Nov. 29, 2012

(65) Prior Publication Data

US 2014/0076110 A1 Mar. 20, 2014

(30) Foreign Application Priority Data

May 21, 2011 (DE) ..... 10 2011 102 241

(51) Int. Cl.
*B25B 13/46* (2006.01)
*B25B 13/04* (2006.01)
(Continued)

(52) U.S. Cl.
CPC ..... *B25B 13/463* (2013.01); *B25B 13/04* (2013.01); *B25B 13/48* (2013.01); *B25B 13/50* (2013.01)

(58) Field of Classification Search
CPC ..... B25B 13/04; B25B 13/463; B25B 13/48; B25B 13/50
See application file for complete search history.

(56) References Cited

U.S. PATENT DOCUMENTS 1,258,382 A * 3/1918 Webb, Jr. ..... B25B 13/463 81/127

(Continued)

FOREIGN PATENT DOCUMENTS

DE 8034956 U 2/1982
DE 9109523 U1 11/1991

(Continued)

OTHER PUBLICATIONS

English language PCT International Search Report mailed Aug. 2, 2012, received in corresponding PCT Application No. PCT/EP12/59053, 2 pgs.

(Continued)

*Primary Examiner* — David B Thomas
(74) *Attorney, Agent, or Firm* — Grossman Tucker Perreault & Pfleger, PLLC

(57) ABSTRACT

The invention relates to a ring ratchet spanner comprising a ratchet head (1) that is closed all the way round, a lever arm (2) that is seated on the ratchet head (1) and is intended for actuating the spanner, a spanner part (3) that is rotatably mounted in the ratchet head (1), a serrated ring (4) that is provided on the outer circumference of the spanner part (3), and a locking element (5) that interacts with the serrated ring (4). The object of the invention is to create a ring ratchet spanner that can be comfortably placed on any nut and easily actuated when working on a wide variety of pipelines. This object is solved by the closed ratchet head (1) consisting of two halves (6, 7) that can be separated from each other, by one of the two halves (6, 7) of the ratchet head (1) being connected to the lever arm (2), by the spanner part (3) that is rotatably mounted on the ratchet head (1) likewise consisting of two halves that can be separated from each other, and by the two halves (6, 7) of the ratchet head (1) being able to be joined together again in a fixed manner after they have been separated and subsequently placed against the nut to be loosened or tightened.

10 Claims, 6 Drawing Sheets

Figure 1:
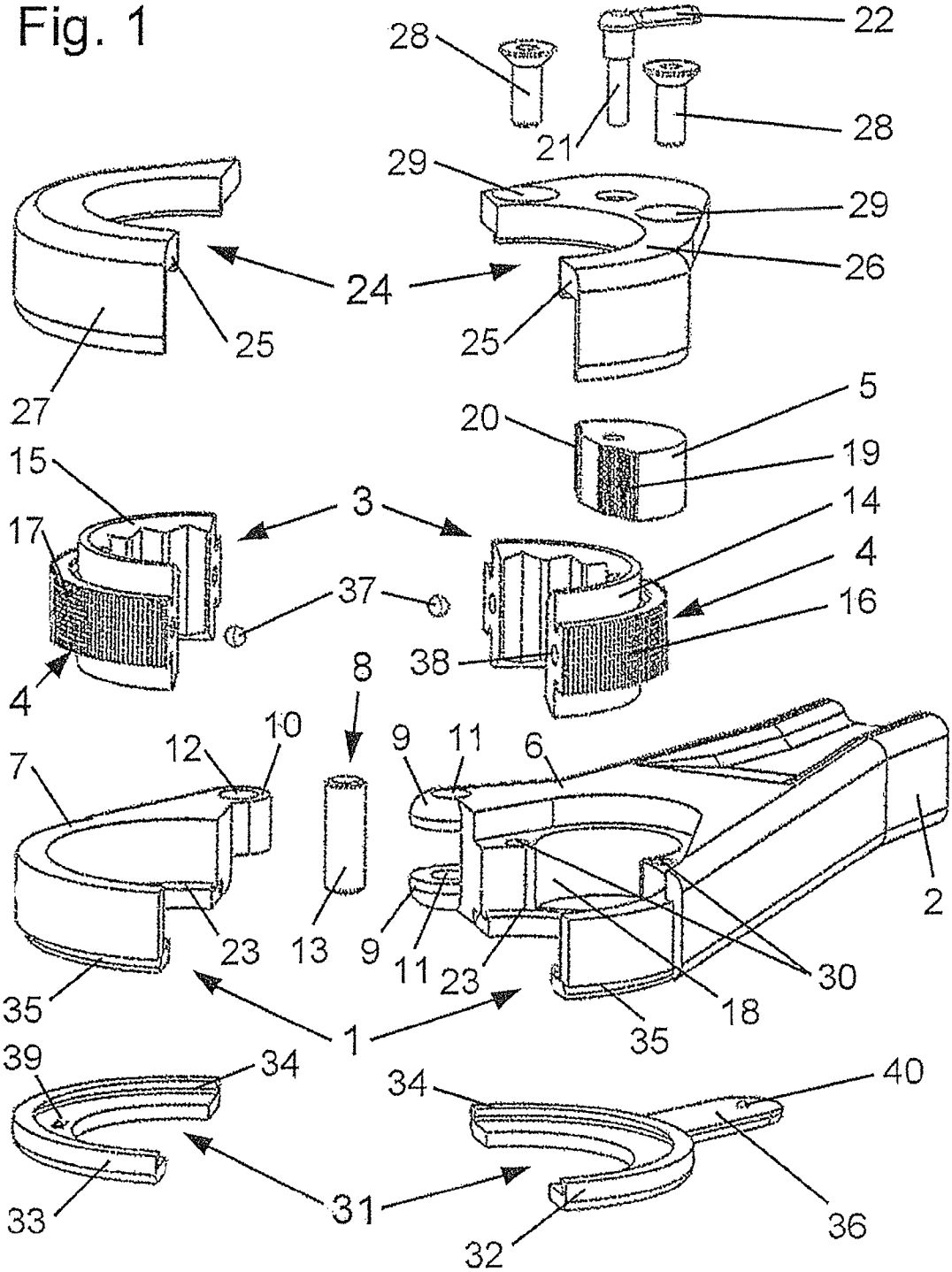

(51) Int. Cl.
*B25B 13/48* (2006.01)
*B25B 13/50* (2006.01)

(56) References Cited

U.S. PATENT DOCUMENTS

| | | | | | |
|---|---|---|---|---|---|
| 2,758,493 | A * | 8/1956 | Goldwater | B25B 13/463 | 81/185.1 |
| 4,095,494 | A | 6/1978 | Castoe | | |
| 4,258,595 | A * | 3/1981 | Ramsey | B25B 13/463 | 81/61 |
| 5,113,726 | A | 5/1992 | Ethridge | | |
| 6,263,765 | B1 | 7/2001 | McCamley | | |
| 2004/0099099 | A1 | 5/2004 | Pearson | | |
| 2005/0028649 | A1 | 2/2005 | Settanni | | |
| 2005/0257650 | A1 | 11/2005 | Hu | | |
| 2014/0033880 | A1 * | 2/2014 | Hill | B25B 13/04 | 81/121.1 |

FOREIGN PATENT DOCUMENTS

| | | | |
|---|---|---|---|
| DE | 202010001662 | U1 | 5/2010 |
| JP | 2000263456 | A | 9/2000 |
| KR | 20000027478 | A | 5/2000 |

OTHER PUBLICATIONS

English language Translation of the International Preliminary Report on Patentability/Written Opinion issued Nov. 26, 2013, received in corresponding PCT Application No. PCT/EP12/59053, 8 pgs.

* cited by examiner

RING RATCHET SPANNER

The invention relates to a ring ratchet spanner comprising a ratchet head that is closed all the way round, a lever arm that is seated on the ratchet head and is intended for actuating the spanner, a spanner part that is rotatably mounted in the ratchet head, a serrated ring that is provided on the outer circumference of the spanner part, and a locking element that interacts with the serrated ring.

DE 10 2005 017 855 B4 discloses a ring ratchet spanner that is closed all the way round and can be placed on a nut or a bolt head from above. On this ring ratchet spanner, the locking element is located in a recess of the lever arm and can be switched from counterclockwise to clockwise action. Use of this ring ratchet spanner on pipelines is not possible.

DE 20 2010 001 662 U1 discloses a ring ratchet spanner where the ratchet head displays a narrow lateral opening. This lateral opening makes it possible to slide the ratchet head over a pipe of a pipeline, for example, and then place it on a nut provided on the pipeline. In this context, the opening of the ring ratchet spanner cannot exceed a certain angular range, as its function would otherwise not be guaranteed, meaning that it can only be used on pipelines that have a small diameter relative to the width across flats of the nut to be actuated. A ring ratchet spanner of this kind moreover has the disadvantage that the ratchet head does not contact the nut to be actuated all the way round. Moreover, relatively wide locking elements have to be provided that bridge the gap in the rotatable spanner part.

The object of the invention is thus to create a ring ratchet spanner that can be comfortably placed on any nut and easily actuated when working on a wide variety of pipelines.

According to the invention, this object is solved by the closed ratchet head consisting of two halves that can be separated from each other, by one of the two halves of the ratchet head being connected to the lever arm, by the spanner part that is rotatably mounted on the ratchet head likewise consisting of two halves that can be separated from each other, and by the two halves of the ratchet head being able to be joined together again in a fixed manner after they have been separated and subsequently placed against the nut to be loosened or tightened.

The ring ratchet spanner according to the invention can thus be opened into two halves and, regardless of the environment of the nut to be actuated, placed laterally against said nut. The ring ratchet spanner according to the invention can then be actuated without difficulty after locking the ratchet head.

Utility model DE 9109523 discloses ratchet pliers where the front jaw halves are each provided with a semicircular spanner part. When the ratchet pliers are closed, the two jaw halves form a ratchet head that, like the ring ratchet spanner according to the invention, can be laterally placed on a nut of a pipeline. Compared to a ring ratchet spanner, ratchet pliers of this kind, which can in each case only be used for a single width across flats, are relatively elaborate and expensive, and also of considerable weight, meaning that a fitter cannot reasonably be expected to carry a large number of ratchet pliers for different widths across flats in his toolbox. Ratchet pliers of this kind are thus not a model for the ring ratchet spanner according to the invention.

In a preferred embodiment of the ring ratchet spanner according to the invention that offers very convenient handling, the two halves of the ratchet head are coupled to each other via a pivoting joint. This results in the advantage that the two halves of the ratchet head are captively connected to each other, and can easily be opened and closed on one side and placed on a nut.

The axis of the pivoting joint is expediently perpendicular to the spanner plane, meaning that laterally placing the ring ratchet spanner against a nut presents no problem whatsoever.

A retaining ring is provided to connect the two halves of the ratchet head. Said retaining ring is expediently of split design, comprising two halves, has an undercut all the way round and is rotatably guided on the ratchet head. This connection constitutes a very elegant locking capability that fits in with an attractive design.

The retaining ring can be rotatable relative to the ratchet head by means of a small hand lever, such that actuation to open and close the ratchet head is very simple and easily possible even for inexperienced persons.

The ratchet head halves can be separated from each other in a first relative position of the retaining ring, in which its two halves coincide with the ratchet head halves, while the ratchet head halves are locked together in a second relative position of the retaining ring, in which the retaining ring halves are offset relative to the ratchet head halves.

To improve the stability of the spanner when the ratchet head is closed, the two halves of the ratchet head can be connectable by means of positively interlocking centring elements.

The centring elements of the one half of the ratchet head are preferably designed as projecting hemispheres that engage hemispherical recesses in the other half of the ratchet head. This centring ensures that the two halves of the ratchet head are exactly aligned relative to each other, such that, for example, the retaining ring that securely holds the ratchet head halves together can be rotated without difficulty.

The locking element that engages the serrated ring of the rotatably mounted spanner part is preferably located in a recess of the lever arm.

The locking element can also be easily switchable from counterclockwise action to clockwise action and vice versa, such that the ring ratchet spanner according to the invention can be used for both left-handed threads and right-handed threads, and for both loosening and tightening a nut.

An example of the invention is illustrated in the drawing and described in detail below on the basis of the drawing. The Figures show the following:

FIG. 1 An exploded view of the ring ratchet spanner according to the invention, with its individual components, FIG. 2 A view from below of the ring ratchet spanner according to FIG. 1, in assembled form and locked position, FIG. 3 The same view as in FIG. 2, but in unlocked position, FIG. 4 The view of the ring ratchet spanner according to FIG. 3 in opened position, FIG. 5 A view of the ring ratchet spanner according to FIG. 1 in assembled form, seen from above, FIG. 6 The view according to FIG. 5 in opened position of the spanner.

Pursuant to the drawing, the ring ratchet spanner according to the invention comprises a ratchet head 1, a lever arm 2 that is seated on ratchet head 1 and intended for actuating the ring ratchet spanner, a spanner part 3 that is rotatably mounted in ratchet head 1, a serrated ring 4 that is provided on the outer circumference of spanner part 3, and a locking element 5 that interacts with serrated ring 4.

As can particularly be seen from FIG. 1 of the drawing, ratchet head 1 consists of two halves 6, 7 that can be separated from each other and are connected via a pivoting joint 8.

Pivoting joint 8 displays two bearing ears 9, a distance apart, that are integrally moulded on the ratchet head half 6 connected to lever arm 2. A bearing pad 10, provided on ratchet head half 7, is inserted between the two bearing ears 9. Both bearing ears 9 and bearing pad 10 are provided with through-holes 11, 12, through which a common journal 13 passes, such that ratchet head half 7 is fastened in pivoting fashion on ratchet head half 6, which is connected to lever arm 2.

Like ratchet head 1, spanner part 3, which is rotatably mounted on ratchet head 1, also consists of two halves 14 and 15, which are rotatably mounted in ratchet head halves 6 and 7.

Serrated ring 4, provided on outer circumference of spanner part 3, likewise consists of two halves 16 and 17 that are each integrally moulded on spanner part halves 14 and 15.

Locking element 5 is located in a recess 18 of lever arm 2. It is provided with two serrated segments 19 and 20, which can optionally be engaged with serrated ring 4 of spanner part 3. To ensure the optional engagement of serrated segments 19 and 20, locking element 5 is mounted in recess 18 of lever arm 2 in pivoting fashion about a shaft 21, arranged perpendicularly to the spanner plane. Shaft 21 can be pivoted by means of a hand lever 22, mounted rigidly on shaft 21, such that locking element 5, which sits tightly on shaft 21, can be pivoted in order to optionally engage serrated segments 19 and 20 with serrated ring 4 of spanner part 3. Pivoting of locking element 5 allows setting of both counterclockwise and clockwise action, such that the ratchet spanner can be used both for left-handed threads and for right-handed threads, and both for loosening and for tightening a nut.

The two halves 14 and 15 of spanner part 3 are each rotatably mounted and fixed in the axial direction in relation to halves 6 and 7 of ratchet head 1.

Serrated ring halves 16 and 17 are axially fixed in halves 6 and 7 of ratchet head 1 in that the underside of serrated ring 4, shown in FIG. 1, rests on an edge 23 running all the way round on ratchet head halves 6 and 7. A split locking ring 24 is fitted from above, having an edge 25 that runs all the way round and rests on the upper edge of serrated ring 4, shown in FIG. 1, such that serrated ring 4 is fixed in the axial direction by the two edges 23 and 25, shown in FIG. 1, running all the way round ratchet head halves 6 and 7 or split locking ring 24.

Halves 26 and 27 of locking ring 24 are fastened on the respective halves 6 and 7 of ratchet head 1. Half 26 is fastened by means of screws 28 to half 6 of ratchet head 1, connected to lever arm 2, where screws 28 reach through corresponding holes 29, provided in locking ring half 26, and are screwed into threaded holes 30 in ratchet head half 6, connected to lever arm 2. Locking ring half 27 is fastened on pivotable ratchet head half 7, e.g. by means of screws not shown in the drawing.

Figure 4:
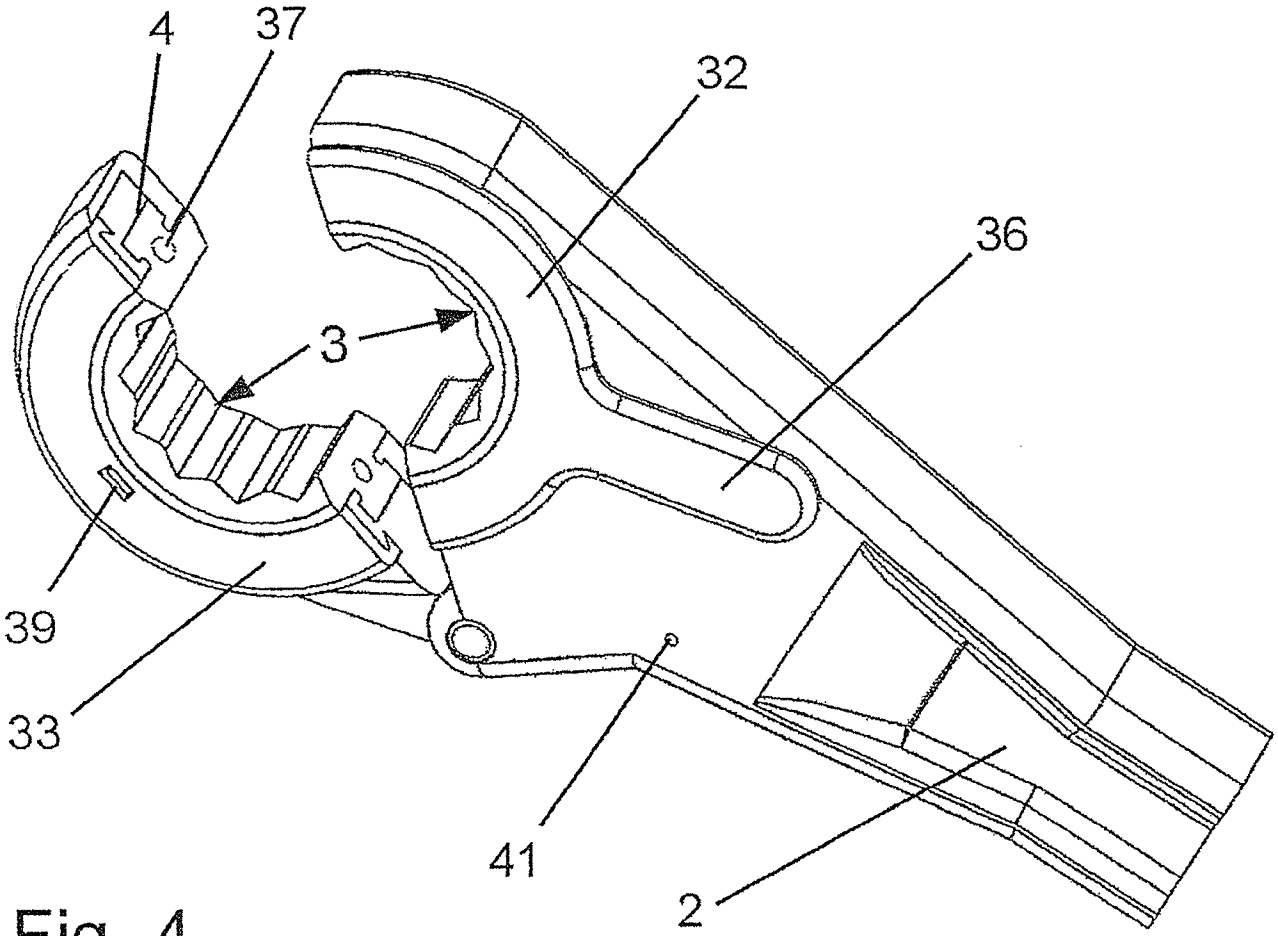
Figure 5:
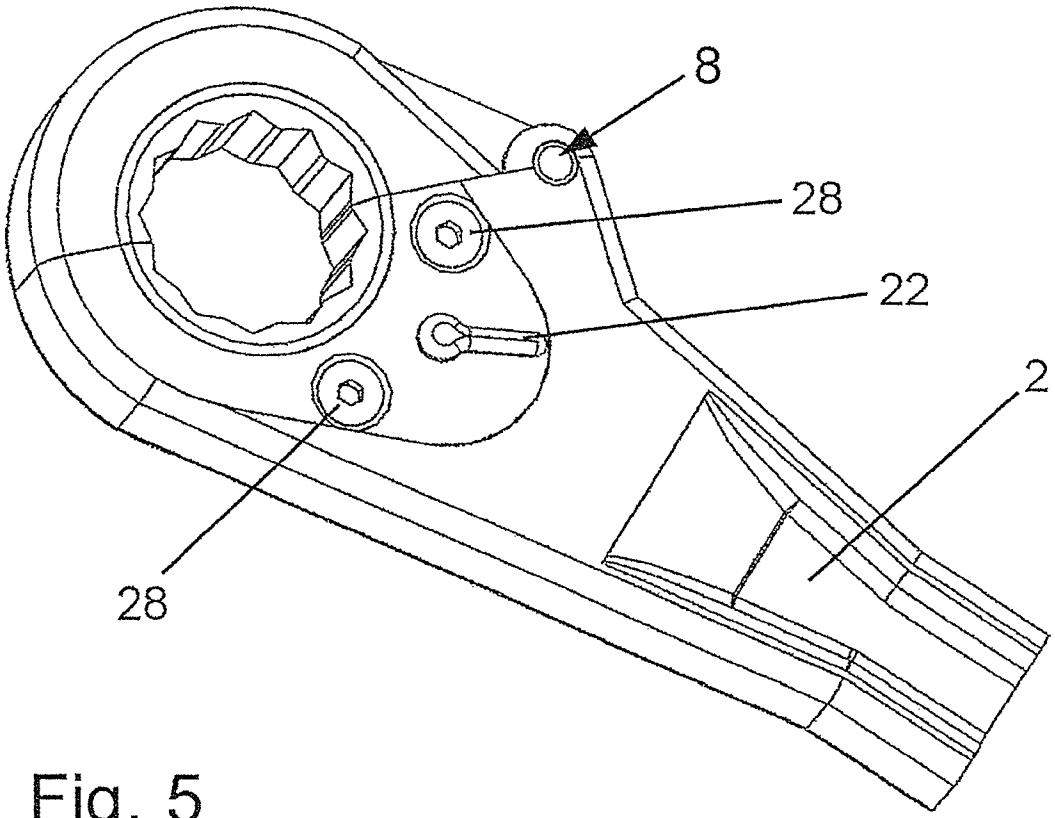
Figure 6:
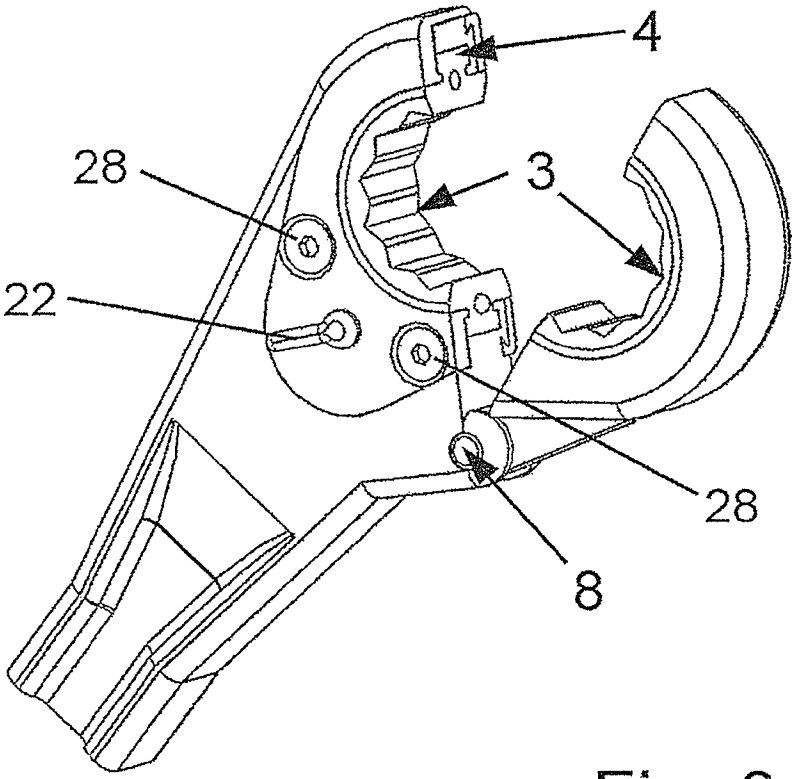

In order to slide the ring ratchet spanner according to the invention over a pipeline and place it on a nut, pivotable half 7 of ratchet head 1 is swung open, as illustrated in FIGS. 4 and 6. Ratchet head half 7 is then swung back against half 6 of ratchet head 1, connected to lever arm 2, and fixed in position on it.

A retaining ring 31 serves to connect the two halves 6 and 7 of ratchet head 1. This retaining ring 31 is divided into two halves 32 and 33, where the two halves 32, 33 are rotatably guided on ratchet head 1. The two halves 32, 33 of retaining ring 31 are provided with an undercut 34 that runs all the way round and reaches around a projection 35 provided all the way round on ratchet head 1.

Retaining ring half 32 can be pivoted by means of a small hand lever 36 and, when ratchet head 1 is closed, also moves the other half 33 of retaining ring 31, since the ends of retaining ring halves 32 and 33 are then in direct contact with each other. In a first relative position of retaining ring 31, in which its two halves 32 and 33 coincide with ratchet head halves 6 and 7, there is no locking action, meaning that ratchet head halves 6 and 7 can be separated from each other. To permit easy location of this relative position, a resilient projection 39, pressed inwards on retaining ring half 33, snaps into a recess provided on ratchet head half 7.

In another relative position of retaining ring 31, in which retaining ring halves 32 and 33 are offset relative to ratchet head halves 6 and 7, the latter are firmly locked together. In this locked position, the ring ratchet spanner according to the invention can be used like a conventional ring ratchet spanner with closed spanner part, in which context the direction of the ratchet action can be specified by setting locking element 5 accordingly.

Figure 2:
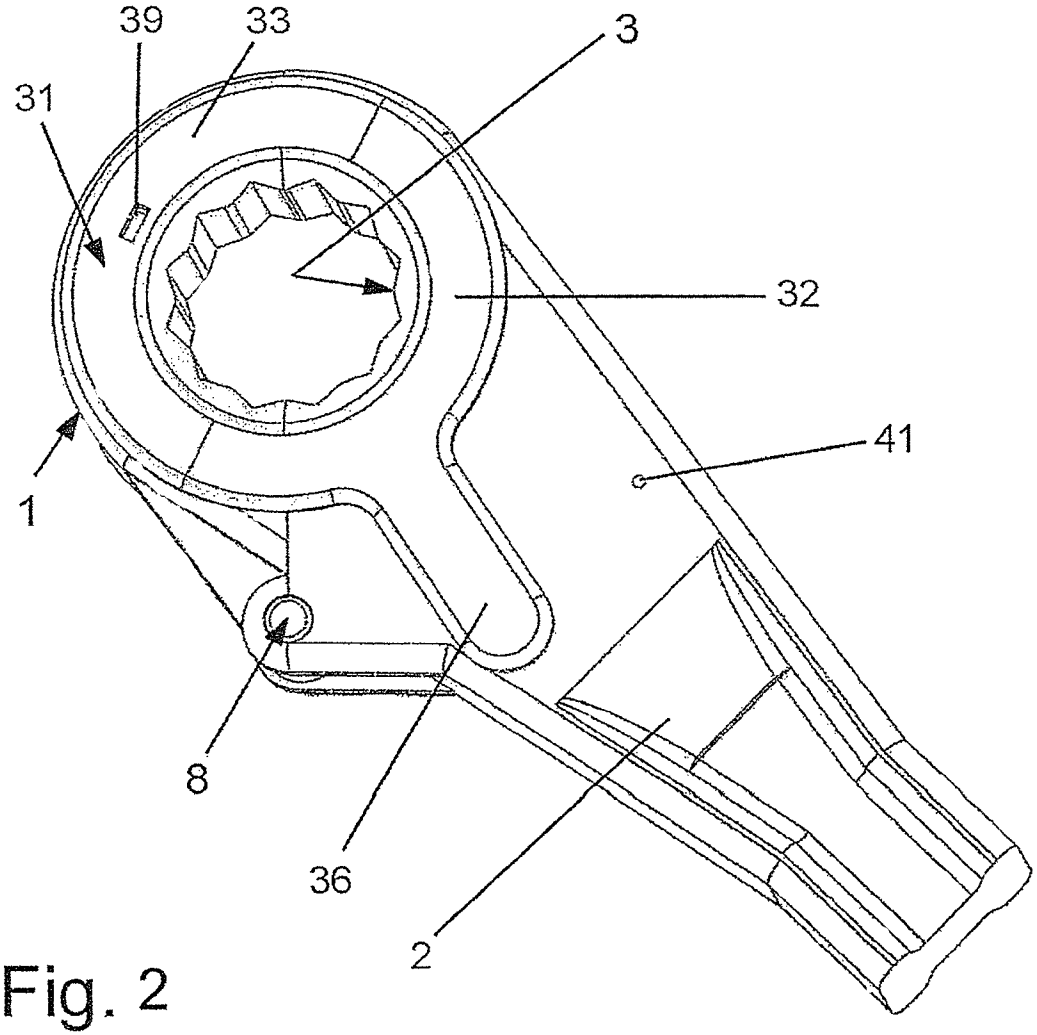
Figure 3:
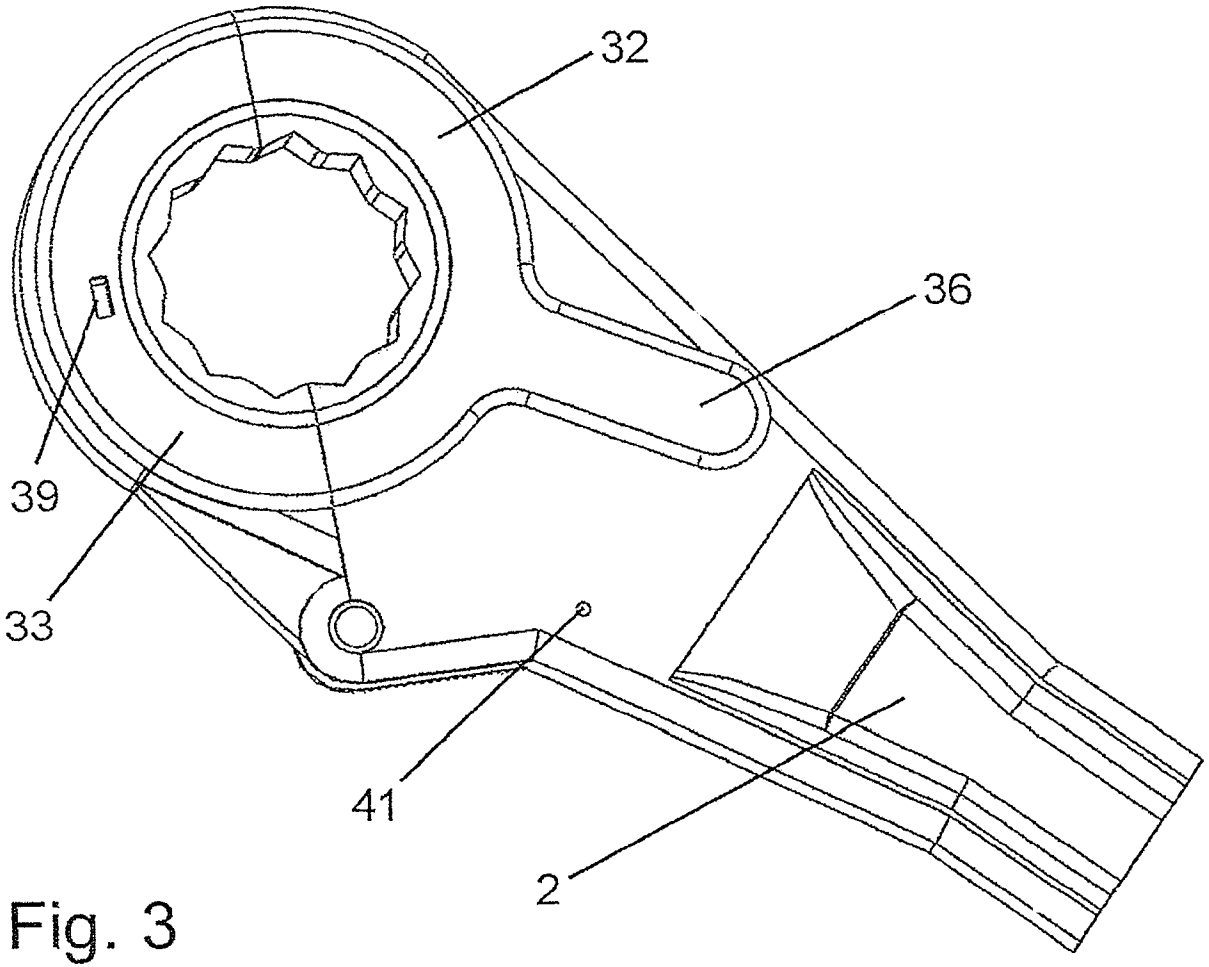

To stably fix the two operating positions, a projection 40 is additionally provided on the inner side of hand lever 36, snapping into a recess 41, provided on lever arm 2, when the respective operating position is reached, as illustrated in FIGS. 2 to 4.

To ensure reliable and accurate joining of ratchet head halves 6 and 7, centring elements are provided on the surfaces lying against each other in closed state of the ratchet head, interlocking positively in joined state of ratchet head 1. In the embodiment illustrated in the drawing, particularly in FIG. 1, the centring elements are located on the ends of halves 14, 15 of spanner part 3 that come into contact with each other, and designed as hemispheres 37 that engage hemispherical recesses 38 in the other half of spanner part 3.

Projecting hemispheres 37 can be produced in a very simple way by fitting full spheres in correspondingly prepared hemispherical recesses by adhesive bonding.

LIST OF REFERENCE NUMBERS

1 Ratchet head
2 Lever arm
3 Spanner part
4 Serrated ring
5 Locking element
6 Half of ratchet head 1
7 Half of ratchet head 1
8 Pivoting joint
9 Bearing ears
10 Bearing pad
11 Through-holes
12 Through-hole
13 Journal
14 Half of spanner part 3
15 Half of spanner part 3
16 Half of serrated ring 4
17 Half of serrated ring 4
18 Recess
19 Serrated segment
20 Serrated segment
21 Shaft of locking element 5
22 Hand lever
23 Edge running all the way round ratchet head halves 6, 7
24 Split locking ring
25 Edge running all the way round locking ring 24
26 Half of locking ring 24
27 Half of locking ring 24
28 Screws
29 Holes
30 Threaded holes

31 Retaining ring
32 Half of retaining ring 31
33 Half of retaining ring 31
34 Undercut
35 Projection running all the way round
36 Hand lever
37 Hemisphere
38 Hemispherical recesses
39 Resilient projection
40 Projection
41 Recess

The invention claimed is:

1. Ring ratchet spanner, comprising a ratchet head that is closed all the way round and consists of two halves that can be separated from each other, a lever arm that is seated on the ratchet head and intended for actuating the spanner, where one of the two halves of the ratchet head is connected to the lever arm, a spanner part that is rotatably mounted in the ratchet head and likewise consists of two halves that can be separated from each other, a serrated ring that is provided on the outer circumference of the spanner part and interacts with a locking element, a retaining ring for connecting the two halves of the ratchet head that consists of two halves, characterised in that the retaining ring is rotatable relative to the ratchet head, in a first relative position of the retaining ring, in which its two halves coincide with the ratchet head halves, the ratchet head halves can be separated from each other, and in a second relative position of the retaining ring (31), in which the retaining ring halves are offset relative to the ratchet head halves, the ratchet head halves are locked together.

2. Ring ratchet spanner according to claim 1, characterised in that the retaining ring can be actuated by means of a hand lever.

3. Ring ratchet spanner according to claim 1, characterised in that the retaining ring is provided with an undercut running all the way round.

4. Ring ratchet spanner according to claim 3, characterised in that the undercut running all the way round the retaining ring reaches around a projection running all the way round the ratchet head in such a way that the two halves of the ratchet head are held together.

5. Ring ratchet spanner according to one of claim 1, characterised in that the two halves of the ratchet head are connected to each other via a pivoting joint.

6. Ring ratchet spanner according to claim 5, characterised in that the axis of the pivoting joint is arranged perpendicularly to the spanner plane.

7. Ring ratchet spanner according to one of claim 1, characterised in that the two halves of the ratchet head can be joined by means of positively interlocking centring elements.

8. Ring ratchet spanner according to claim 7, characterised in that the centring elements are located on the ends of the halves of the spanner part that come into contact with each other and designed as hemispheres that engage hemispherical recesses in the other half of the spanner part.

9. Ring ratchet spanner according to one of claim 1, characterised in that the locking element that engages the serrated ring of the rotatably mounted spanner part is located in a recess in the lever arm.

10. Ring ratchet spanner according to claim 9, characterised in that the locking element is switchable from counterclockwise action to clockwise action and vice versa, such that the ring ratchet spanner can be used for both left-handed threads and right-handed threads, and for both loosening and tightening a nut.

* * * * *